US010864455B1

(12) United States Patent
Earvin

(10) Patent No.: US 10,864,455 B1
(45) Date of Patent: Dec. 15, 2020

(54) ENHANCED JUMPING TOY

(71) Applicant: Johnathan Earvin, Portchester, NY (US)

(72) Inventor: Johnathan Earvin, Portchester, NY (US)

( * ) Notice: Subject to any disclaimer, the term of this patent is extended or adjusted under 35 U.S.C. 154(b) by 0 days.

(21) Appl. No.: 16/666,682

(22) Filed: Oct. 29, 2019

Related U.S. Application Data

(63) Continuation-in-part of application No. 16/253,286, filed on Jan. 22, 2019, now Pat. No. 10,478,713.

(51) Int. Cl.
*A63H 37/00* (2006.01)

(52) U.S. Cl.
CPC ..... *A63H 37/005* (2013.01)

(58) Field of Classification Search
CPC ..... A63F 7/2472; A63H 37/00; A63H 37/005; A63H 33/00; A63H 13/10; A63H 3/46; A63H 13/00; A63H 3/003; A63H 13/02; A63H 11/06; A63H 3/00; A63H 1/00; A63G 3/28
USPC ..... 446/486, 312, 308, 309
See application file for complete search history.

(56) References Cited

U.S. PATENT DOCUMENTS 2,224,456 A * 12/1940 Janas ..... A63H 3/04 446/300
2,627,700 A * 2/1953 Weiss ..... A63H 11/06 446/312
2,824,409 A * 2/1958 Brodrib ..... A63H 7/02 446/312
3,526,991 A * 9/1970 Goldfarb ..... A63H 11/06 446/177
3,603,030 A 9/1971 Bart
D226,773 S 4/1973 Ehrenreicli
4,037,357 A 7/1977 Monroe
5,213,538 A 5/1993 Willett
5,827,107 A * 10/1998 Bears ..... A63H 1/20 446/263
5,941,755 A 8/1999 Danielian
6,017,261 A * 1/2000 Wachtel ..... A63H 3/28 40/415
6,746,301 B1 * 6/2004 Lund ..... A63H 11/06 446/298

(Continued)

FOREIGN PATENT DOCUMENTS

WO 9939794 8/1999

*Primary Examiner* — Michael D Dennis
(74) *Attorney, Agent, or Firm* — Kyle A. Fletcher, Esq.

(57) ABSTRACT

This non-provisional application is a continuation-in-part application that incorporates non-provisional application U.S. 16/253,286 in its entirety and that presents enhancements to this prior disclosure. The enhanced jumping toy comprises the puppet and the plurality of springs of the prior disclosure. The enhanced jumping toy further comprises a pedestal. The puppet of the prior disclosure further comprises an anchor post and a grip tab. The plurality of springs further comprises a plurality of end caps. The pedestal is a stand that forms an anchor point on which the puppet attaches for storage. The anchor post is a structure that attaches to the puppet of the prior disclosure. The anchor post attaches the puppet to the pedestal. The grip tab is a handle that attaches to the puppet. Each of the plurality of end caps is a protective structure that attaches to a spring selected from the plurality of springs.

18 Claims, 6 Drawing Sheets

(56) References Cited

U.S. PATENT DOCUMENTS

| | | | | |
|---|---|---|---|---|
| 7,222,859 | B2 | 5/2007 | Mitvalsky | |
| 2001/0054518 | A1* | 12/2001 | Buehler | B62D 63/02<br>180/8.1 |
| 2007/0117494 | A1* | 5/2007 | Sheller | A63H 13/18<br>446/309 |
| 2013/0316613 | A1* | 11/2013 | O'Hare | A63H 33/00<br>446/487 |

* cited by examiner

ENHANCED JUMPING TOY

CROSS REFERENCES TO RELATED APPLICATIONS

This non-provisional application is a continuation-in-part application filed under 37 CFR 1.53(b) that claims the benefit of United States 35 USC 120 from non-provisional application U.S. 16/253,286 filed on Jan. 22, 2019 by the inventor: Johnathan Earvin of Port Chester, N.Y. This non-provisional application incorporates non-provisional application U.S. Ser. No. 16/253,286 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports, games, and amusements including toys, more specifically, a popper toy that jumps when returning after deformation into its relaxed shape. (A63H37/005).

This non-provisional application is a continuation-in-part application filed under 37 CFR 1.53(b) that claims the benefit of United States 35 USC 120 from non-provisional application U.S. 16/253,286 filed on Jan. 22, 2019 by the inventor: Johnathan Earvin of Port Chester, N.Y. This non-provisional application incorporates non-provisional application U.S. Ser. No. 16/253,286 in its entirety.

The present disclosure will only reference the elements of the non-provisional application U.S. Ser. No. 16/253,286 that are relevant to the innovations disclosed within this application. This is done for purposes of simplicity and clarity of exposition. The applicant notes that this disclosure incorporates non-provisional application U.S. Ser. No. 16/253,286 in its entirety into this application. The fact that any specific innovation selected from the one or more innovations disclosed within U.S. Ser. No. 16/253,286 is not addressed in this application should not be interpreted as an indication of defect in the above referenced patent.

Within this disclosure, the non-provisional application U.S. Ser. No. 16/253,286 will also be referred to as the prior disclosure.

A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure describes a child's toy. The prior disclosure comprises a puppet 101, a plurality of springs 102, and a counter. The counter and the plurality of springs 102 attach to the puppet 101. The prior disclosure is configured for use with a supporting surface 171. The prior disclosure is pressed against the supporting surface 171 such that the plurality of springs 102 are deformed. When the prior disclosure is released, each of the plurality of springs 102 returns to its relaxed position such that the prior disclosure "jumps" to an elevation above the supporting surface 171. The counter is a mechanical device. The counter counts the number of times the prior disclosure jumps. The puppet 101 is a composite prism structure that visually presents a dynamic expression during the use of the prior disclosure.

The puppet 101 is a mechanical structure. The puppet 101 is configured to present an image. The image presented by the puppet 101 comprises indicia which represent the sentiment of an expression. The puppet 101 has the shape of a composite prism.

The counter is a mechanical device. The counter is a commercially available device. The counter attaches to the puppet 101. The counter attaches to a spring selected from the plurality of springs 102 such that the elevation of the puppet 101 by the selected spring advances the counter.

Each of the plurality of springs 102 is a flat spring. Each of the plurality of springs 102 attaches to the exterior of the puppet 101 in the manner of a cantilever. The each of the plurality of springs 102 is a plate-shaped flat spring. Each of the plurality of springs 102 is as a spring. Specifically, when a force is applied perpendicular to the center axis of any spring selected from the plurality of springs 102, the elasticity of the selected spring creates a rotational torque that opposes the initial displacement created by rotating the selected spring. This rotational torque places a strain on the selected spring such that the force of the strain is in the direction that returns the selected spring to its original position. The energy returned by each of the plurality of springs 102 is such that the invention 100 elevates above the supporting surface 171 when each plurality of springs 102 simultaneously return to their relaxed shape.

Two shortcomings of the prior disclosure have been subsequently identified since the filing of the prior disclosure. Specifically, the prior disclosure failed to provide for a proper storage mechanism that prevents the counter from advancing while the prior disclosure is not in use. Additionally, the use of flat springs as the spring of choice for each of the plurality of springs 102 has the potential to damage the supporting surface 171 on which the prior disclosure is used.

Clearly: a) a method to appropriately store the prior disclosure; and, b) a method to protect the supporting surface during the use of the prior disclosure would be of benefit to those using the prior disclosure.

SUMMARY OF INVENTION

This non-provisional application is a continuation-in-part application filed under 37 CFR 1.53(b) that claims the benefit of United States 35 USC 120 from non-provisional application U.S. 16/253,286 filed on Jan. 22, 2019 by the inventor: Johnathan Earvin of Port Chester, N.Y. This non-provisional application incorporates non-provisional application U.S. Ser. No. 16/253,286 in its entirety.

The present disclosure will only reference the elements of the non-provisional application U.S. Ser. No. 16/253,286 that are relevant to the innovations disclosed within this application. This is done for purposes of simplicity and clarity of exposition. The applicant notes that this disclosure incorporates non-provisional application U.S. Ser. No. 16/253,286 in its entirety into this application. The fact that any specific innovation selected from the one or more innovations disclosed within U.S. Ser. No. 16/253,286 is not addressed in this application should not be interpreted as an indication of defect in the above referenced patent.

Within this disclosure, the non-provisional application U.S. 16/253,286 will also be referred to as the prior disclosure.

This disclosure presents enhancements to the prior disclosure that address the shortcomings in the prior disclosure that have been previously described. The enhanced jumping toy comprises the puppet 101 of the prior disclosure, the plurality of springs 102 of the prior disclosure, and the counter of the prior disclosure. The enhanced jumping toy further comprises a pedestal. The puppet 101 of the prior disclosure further comprises an anchor post and a grip tab. The plurality of springs further comprises a plurality of end caps.

The pedestal is a stand that forms an anchor point on which the puppet 101 attaches for storage. The anchor post is a structure that attaches to the puppet 101 of the prior disclosure. The anchor post attaches the puppet 101 to the pedestal. The grip tab is a handle that attaches to the puppet 101. Each of the plurality of end caps is a protective structure that attaches to a spring selected from the plurality of springs.

These together with additional objects, features and advantages of the enhanced jumping toy will be readily apparent to those of ordinary skill in the art upon reading the following detailed description of the presently preferred, but nonetheless illustrative, embodiments when taken in conjunction with the accompanying drawings.

In this respect, before explaining the current embodiments of the enhanced jumping toy in detail, it is to be understood that the enhanced jumping toy is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the enhanced jumping toy.

It is therefore important that the claims be regarded as including such equivalent construction insofar as they do not depart from the spirit and scope of the enhanced jumping toy. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
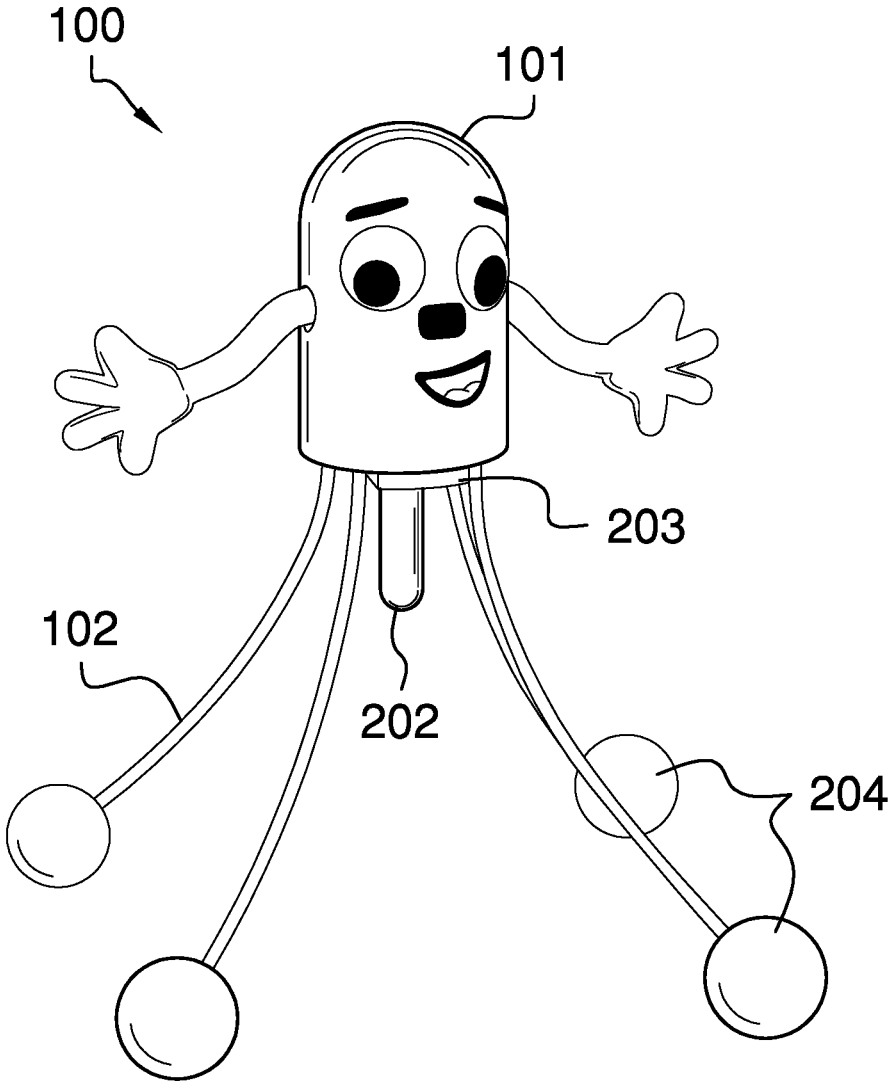
FIG. 1 is a perspective view of an embodiment of the disclosure.
Figure 2:
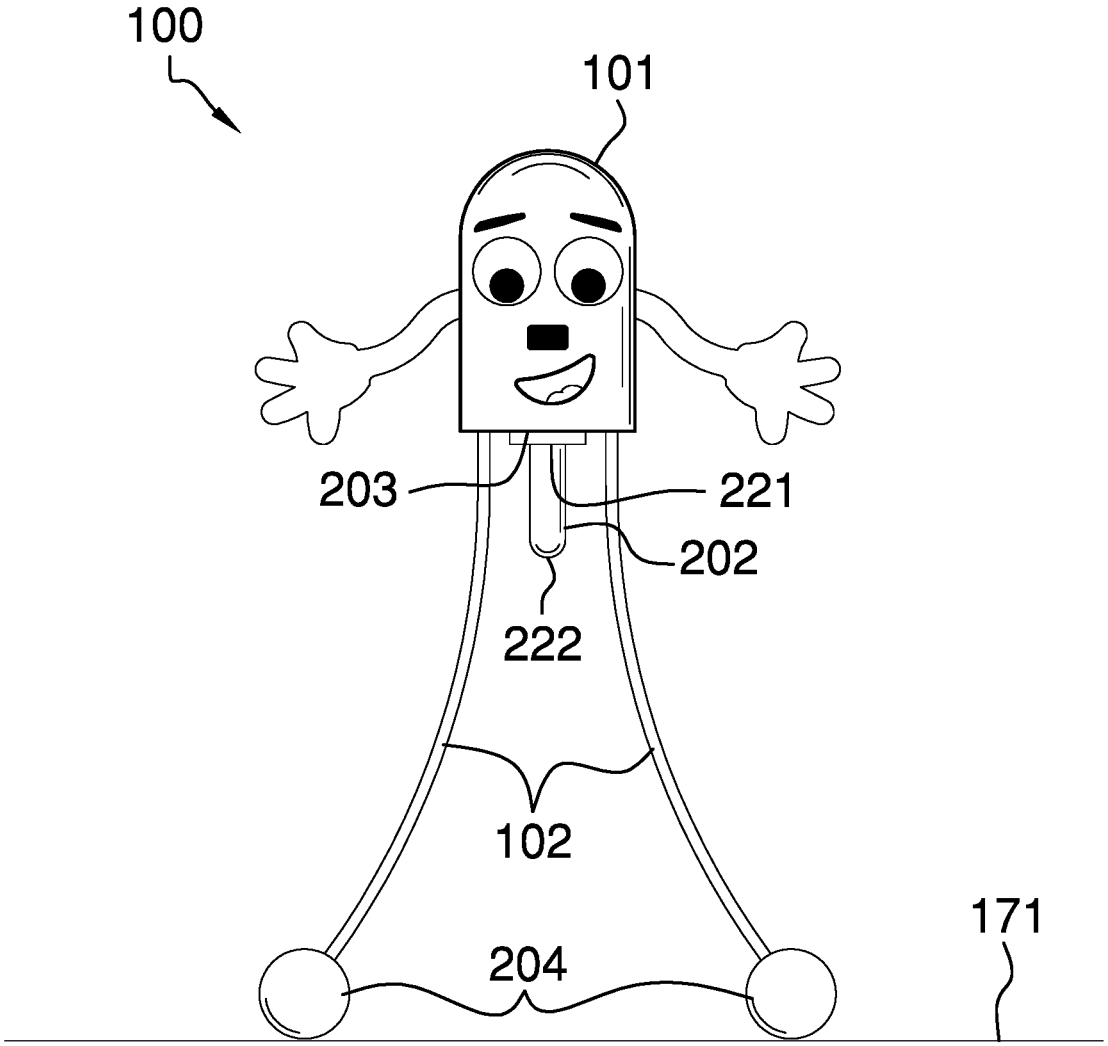
FIG. 2 is a front view of an embodiment of the disclosure.
Figure 3:
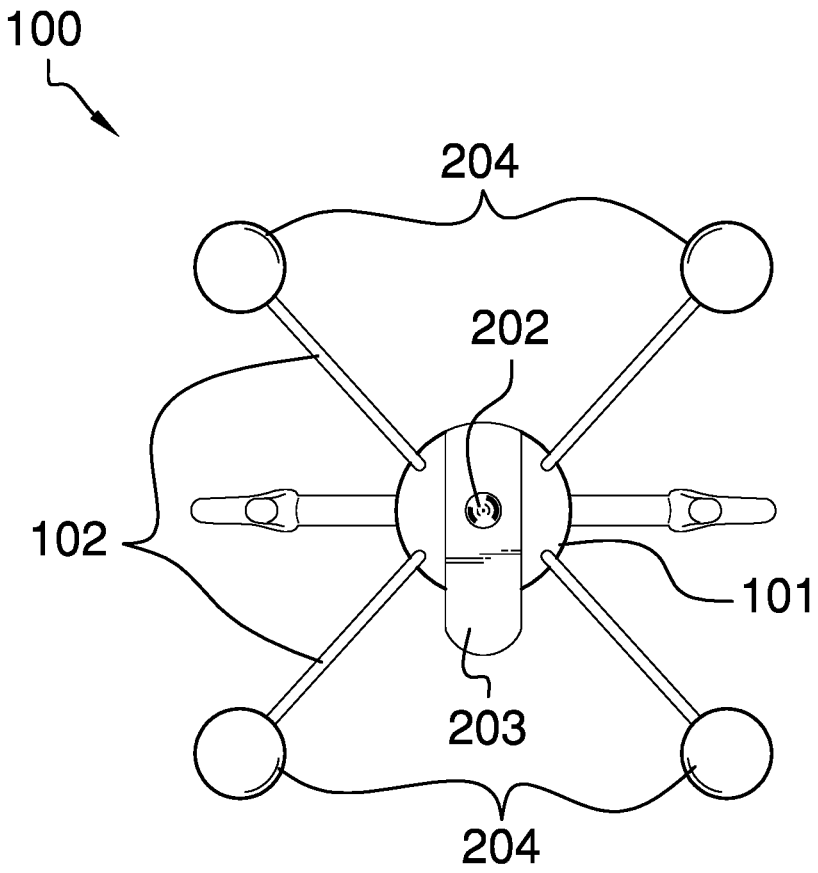
FIG. 3 is a bottom view of an embodiment of the disclosure.
Figure 4:
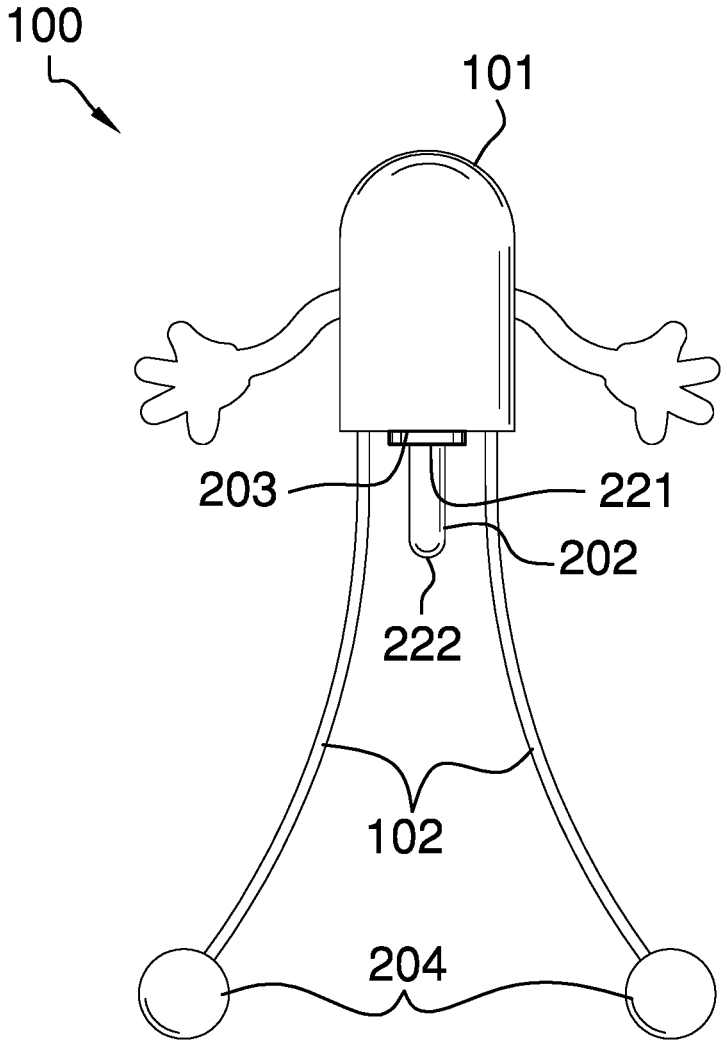
FIG. 4 is a rear view of an embodiment of the disclosure.
Figure 5:
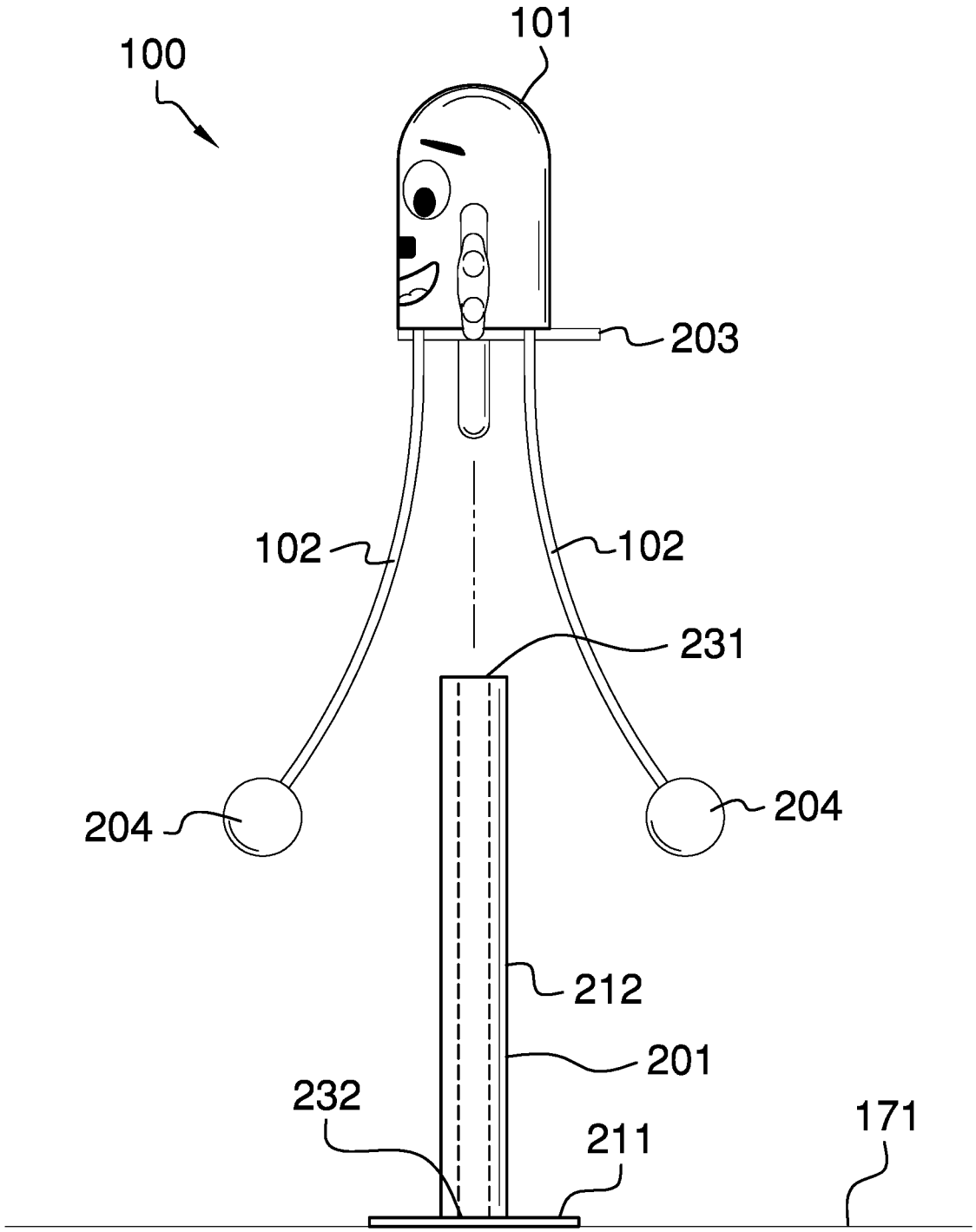
FIG. 5 is a side view of an embodiment of the disclosure.
Figure 6:
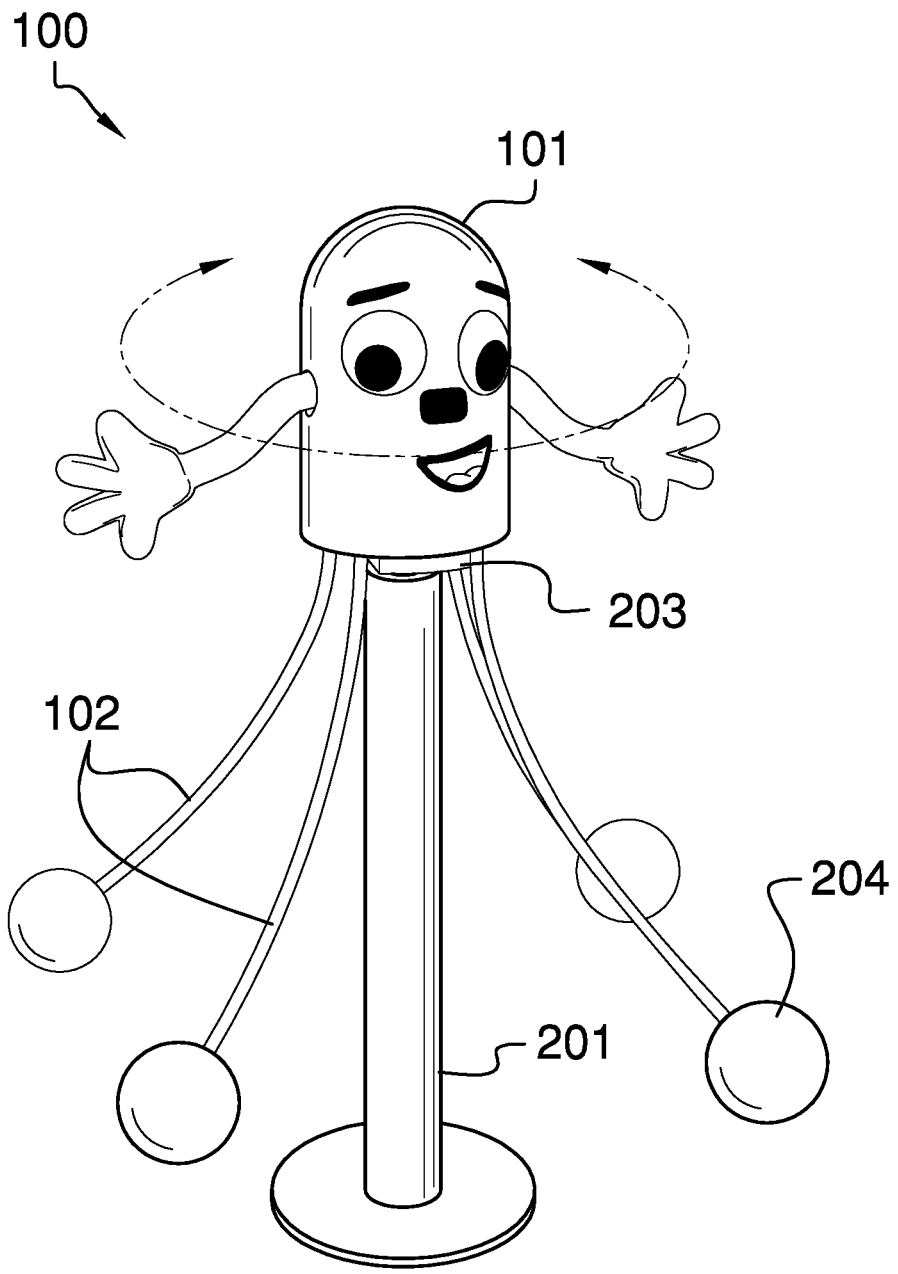
FIG. 6 is an in-use view of an embodiment of the disclosure.

Detailed reference will now be made to one or more potential embodiments of the disclosure, which are illustrated in FIGS. 1 through 6.

This non-provisional application is a continuation-in-part application filed under 37 CFR 1.53(b) that claims the benefit of United States 35 USC 120 from non-provisional application U.S. Ser. No. 16/253,286 filed on Jan. 22, 2019 by the inventor: Johnathan Earvin of Port Chester, N.Y. This non-provisional application incorporates non-provisional application U.S. Ser. No. 16/253,286 in its entirety.

The present disclosure will only reference the elements of the non-provisional application U.S. Ser. No. 16/253,286 that are relevant to the innovations disclosed within this application. This is done for purposes of simplicity and clarity of exposition. The applicant notes that this disclosure incorporates non-provisional application U.S. Ser. No. 16/253,286 in its entirety into this application. The fact that any specific innovation selected from the one or more innovations disclosed within U.S. Ser. No. 16/253,286 is not addressed in this application should not be interpreted as an indication of defect in the above referenced patent.

Within this disclosure, the non-provisional application U.S. 16/253,286 will also be referred to as the prior disclosure.

This disclosure presents enhancements to the prior disclosure that address the shortcomings in the prior disclosure that have been previously described. The enhanced jumping toy 100 (hereinafter invention) comprises the puppet 101 of the prior disclosure, the plurality of springs 102 of the prior disclosure, and the counter of the prior disclosure. The invention 100 further comprises a pedestal 201. The puppet 101 of the prior disclosure further comprises an anchor post 202 and a grip tab 203. The plurality of springs 102 further comprises a plurality of end caps 204.

The puppet 101 is described in the background section of this disclosure. The plurality of springs 102 are described in the background section of this disclosure. The supporting surface 171 is defined elsewhere in this disclosure.

The pedestal 201 is a stand that forms an anchor point on which the puppet 101 attaches for storage. The anchor post 202 is a structure that attaches to the puppet 101 of the prior disclosure. The anchor post 202 attaches the puppet 101 to the pedestal 201. The grip tab 203 is a handle that attaches to the puppet 101. Each of the plurality of end caps 204 is a protective structure that attaches to a spring selected from the plurality of springs 102.

The pedestal 201 is a mechanical structure. The pedestal 201 forms an anchor point to which the puppet 101 attaches. The pedestal 201 elevates the puppet 101 such that the puppet 101 rests above the supporting surface 171, and is able to rotate with respect to the pedestal 201. The anchor post 202 is a prism-shaped shaft structure. The pedestal 201 comprises a base disk 211 and a stanchion 212.

The base disk 211 is a disk-shaped structure. The base disk 211 forms the inferior structure of the pedestal 201. The base disk 211 forms the portion of the load path formed by the pedestal 201 that transfers the load of the puppet 101 to the supporting surface 171. A congruent end of the disk structure of the base disk 211 rests on the supporting surface 171. The stanchion 212 attaches to the congruent end of the base disk 211 that is distal from the supporting surface 171.

The stanchion 212 is a vertically oriented structure. The stanchion 212 is a hollow tubular structure. The stanchion 212 forms the superior structure of the pedestal 201. The stanchion 212 forms the portion of the load path formed by the pedestal that transfers the load of the puppet 101 to the supporting surface 171. The stanchion 212 further comprises a superior end 231 and an inferior end 232. The superior end 231 is the congruent end of the prism structure of the stanchion 212 that is distal from the inferior end 232. The superior end 231 is an open end that allows access into the hollow interior of the stanchion 212. The inferior end 232 is the congruent end of the prism structure of the stanchion 212 that attaches to the base disk 211. The inferior end 232 is the congruent end of the prism structure of the stanchion 212 that is distal from the superior end 231.

The anchor post 202 attaches to the puppet 101 in the manner of a cantilever. The anchor post 202 secures the puppet 101 to the pedestal 201. The congruent ends of the prism structure of the anchor post 202 are geometrically similar to the congruent ends of the tubular structure of the stanchion 212 of the pedestal 201. The span of the outer dimension of the prism structure of the anchor post 202 is lesser than the span of the inner diameter of the tubular structure of the stanchion of the pedestal 201 such that the anchor post 202 inserts into the pedestal 201. The anchor post 202 attaches the puppet 101 to the pedestal 201 by inserting into the superior end 231 of the stanchion 212. The anchor post 202 further comprises a fixed end 221 and a free end 222. The fixed end 221 is the congruent end of the prism structure of the anchor post 202 that attaches to the puppet 101. The free end 222 is the congruent end of the prism structure of the anchor post 202 that is distal from the fixed end 221.

The grip tab 203 is a disk-shaped structure. The grip tab 203 attaches to the exterior surface of the puppet 101 such that a portion of the grip tab 203 extends beyond the exterior surfaces of the puppet 101.

Each of the plurality of end caps 204 attaches to a flat spring selected from the plurality of springs 102. There is a one to one correspondence between the plurality of end caps 204 and the plurality of springs 102. Each of the plurality of end caps 204 attaches to the end of its associated flat spring that is distal from the puppet 101. Each of the plurality of end caps 204 is a sacrificial structure that prevents the supporting surface 171 from being damaged by the end of the associated flat spring. In the first potential embodiment of the disclosure, each of the plurality of end caps 204 is formed from an elastic material that encloses the end of the associated flat spring.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Cap: As used in this disclosure, a cap is a sacrificial structure that protects the free end of a cantilever structure.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure formed from a plurality of structures selected from the group consisting of a prism structure, a pyramid structure, and a spherical structure. The plurality of selected structures may or may not be truncated. The plurality of prism structures are joined together such that the center axes (or spherical diameter) of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Always use Geometrically similar, correspond and one to one Copolymer: As used in this disclosure, a copolymer is a polymer formed from two or more repeating molecules (also referred to as monomers).

Correspond: As used in this disclosure, the term correspond is used as a comparison between two or more objects wherein one or more properties shared by the two or more objects match, agree, or align within acceptable manufacturing tolerances.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. Specifically, the surface area of an end of the prism-shaped object that forms the disk is greater than the lateral face of the prism-shaped object that forms the disk. In this disclosure, the ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Expression: As used in this disclosure, an expression is a term that refers to the visual appearance of a human face. It is believed that certain expressions displayed on the human face correlate to an emotional state. This correlation is exploited, often through caricature, in artistic representations of the human figure.

Flat Spring: As used in this disclosure, a flat spring is a device designed to store and release mechanical energy that is made of a flat or conical piece of material.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hemisphere: As used in this disclosure, a hemisphere is a structure formed in the shape of a half a sphere. Such a structure would be described as hemispherical.

Image: As used in this disclosure, an image is an optical representation or reproduction of an indicia or of the appearance of something or someone.

Indicia: As used in this disclosure, the term indicia refers to a set of markings that identify a sentiment.

Inner Dimension: As used in this disclosure, the term inner dimension describes the span from a first inside or interior surface of a container to a second inside or interior surface of a container. The term is used in much the same way that a plumber would refer to the inner diameter of a pipe.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Monomer: As used in this disclosure, a monomer refers to a molecular structure that bonds to itself in a repeating manner to form a polymer.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Oval: As used in this disclosure, an oval is a geometric shape that is formed in the shape of a "squished" circle similar in form to an ellipse. The difference between an oval and an ellipse is that an ellipse can be described by a mathematical formula while an oval has no such description. The term ovoid refers to a three-dimensional structure with an oval shape that is analogous to the relationship of an ellipsoid and an ellipse.

Organic: As used in this disclosure, organic refers to a carbon-based chemical structure. A limited number of carbon-based salts are traditionally considered inorganic chemical structures and are excluded from the study of organic chemistry.

Pedestal: As used in this disclosure, a pedestal is an intermediary load bearing structure that that forms a load path between a supporting surface and an object, structure, or load.

Plastic: As used in this disclosure, plastic refers to a manufactured material that is formed from a structure selected from the group consisting of a polymer or a copolymer. Unless stated otherwise, this disclosure assumes that the plastic is formed from organic monomers.

Polymer: As used in this disclosure, a polymer refers to a molecular chain that comprises multiple repeating units known as monomers. The repeating unit may be an atom or a molecular structure.

Post: As used in this disclosure, a post is a shaft that is: 1) set into a surface; and 2) provides a supporting structure that is perpendicular to the surface.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder. See Truss.

Puppet: As used in this disclosure, a puppet is a figure resembling a human, animal or symbolic image that can be moved and that is used for entertainment or educational purposes. Puppets are often used as tokens within a board game.

Radial: As used in this disclosure, the term radial refers to a direction that: 1) is perpendicular to an identified central axis; or, 2) projects away from a center point.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Sacrificial Structure: As used in this disclosure, a sacrificial structure is a first object or structure that protects a second object or structure from damage. More specifically, the sacrificial structure protects the second object or structure by being damaged instead of the second object or structure.

Semi-Rigid Structure: As used in this disclosure, a semi-rigid structure is a solid structure that is stiff but not wholly inflexible, and that will deform under force before breaking. A semi-rigid structure may or may not behave with an elastic nature in that a semi-rigid structure need not return to its relaxed shape.

Sentiment: As used in this disclosure, a sentiment refers to a symbolic meaning or message that is communicated through the use of an image, potentially including a text-based image.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Torque: As used in this disclosure, a torque refers to a force that causes an object to rotate.

Torsion: As used in this disclosure, torsion refers to the application of a torque to an object.

Torsion Spring: As used in this disclosure, a torsion spring is a mechanical device that stores mechanical energy through an opposing torque when the mechanical device is bent or twisted. The torsion spring will return to its original relaxed shape when the twisting force is removed.

Truncated: As used in this disclosure, a geometric object is truncated when an apex, vertex, or end is cut off by a line or plane.

Tube: As used in this disclosure, the term tube is used to describe a rigid hollow prism-shaped device with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claims:

1. An enhanced jumping toy comprising
wherein the enhanced jumping toy comprises a puppet, a pedestal, and a plurality of springs;
wherein the puppet further comprises an anchor post and a grip tab;
wherein the plurality of springs further comprises a plurality of end caps;
wherein the anchor post attaches the puppet to the pedestal;
wherein the grip tab is a handle that attaches to the puppet;
wherein each of the plurality of end caps is a protective structure that attaches to a spring selected from the plurality of springs;
wherein the plurality of springs enable the puppet to flip or otherwise jump with respect to a supporting surface.

2. The enhanced jumping toy according to claim 1
wherein the pedestal is a mechanical structure;
wherein the pedestal forms an anchor point to which the puppet rests and spins.

3. The enhanced jumping toy according to claim 2 wherein the pedestal elevates the puppet such that the puppet rests above the supporting surface; wherein the puppet is able to rotate with respect to the pedestal.

4. The enhanced jumping toy according to claim 3 wherein the anchor post is a prism-shaped shaft structure.

5. The enhanced jumping toy according to claim 4
wherein the anchor post attaches to the puppet in the manner of a cantilever;
wherein the anchor post secures the puppet to the pedestal.

6. The enhanced jumping toy according to claim 5 wherein the grip tab attaches to the exterior surface of the puppet such that a portion of the grip tab extends beyond the exterior surfaces of the puppet.

7. The enhanced jumping toy according to claim 6 wherein each of the plurality of end caps attaches to a spring selected from the plurality of springs; wherein each of the plurality of end caps attaches to an end of its associated spring that is distal from the puppet.

8. The enhanced jumping toy according to claim 7 wherein there is a one to one correspondence between the plurality of end caps and the plurality of springs.

9. The enhanced jumping toy according to claim 8
wherein the pedestal comprises a base disk and a stanchion;
wherein the stanchion attaches to the base disk.

10. The enhanced jumping toy according to claim 9
wherein the base disk is a disk-shaped structure;
wherein the base disk forms an inferior structure of the pedestal;
wherein a congruent end of the disk structure of the base disk rests on the supporting surface;
wherein the stanchion attaches to the congruent end of the base disk that is distal from the supporting surface.

11. The enhanced jumping toy according to claim 10
wherein the stanchion is a vertically oriented structure;
wherein the stanchion is a hollow tubular structure;
wherein the stanchion forms a superior structure of the pedestal.

12. The enhanced jumping toy according to claim 11
wherein the stanchion further comprises a superior end and an inferior end;
wherein the superior end is the congruent end of the prism structure of the stanchion that is distal from the inferior end;
wherein the superior end is an open end that allows access into the hollow interior of the stanchion;
wherein the inferior end is the congruent end of the prism structure of the stanchion that attaches to the base disk;
wherein the inferior end is the congruent end of the prism structure of the stanchion that is distal from the superior end.

13. The enhanced jumping toy according to claim 12 wherein the congruent ends of the prism structure of the anchor post are geometrically similar to the congruent ends of the tubular structure of the stanchion of the pedestal.

14. The enhanced jumping toy according to claim 13 wherein the span of the outer dimension of the prism structure of the anchor post is lesser than a span of the inner diameter of the tubular structure of the stanchion of the pedestal such that the anchor post inserts into the pedestal.

15. The enhanced jumping toy according to claim 14 wherein the anchor post attaches the puppet to the pedestal by inserting into the superior end of the stanchion.

16. The enhanced jumping toy according to claim 15
wherein the anchor post further comprises a fixed end and a free end;
wherein the fixed end is the congruent end of the prism structure of the anchor post that attaches to the puppet;
wherein the free end is the congruent end of the prism structure of the anchor post that is distal from the fixed end.

17. The enhanced jumping toy according to claim 16 wherein the grip tab is a disk-shaped structure.

18. The enhanced jumping toy according to claim 17 wherein each of the plurality of end caps is formed from an elastic material that encloses the end of the associated spring.

* * * * *